US007293765B2

(12) United States Patent
Hooper

(10) Patent No.: US 7,293,765 B2
(45) Date of Patent: Nov. 13, 2007

(54) POWER VISE

(76) Inventor: Ronald L. Hooper, 5091 US Highway 79 N., Brownsville, TN (US) 38012

( * ) Notice: Subject to any disclaimer, the term of this patent is extended or adjusted under 35 U.S.C. 154(b) by 0 days.

(21) Appl. No.: 11/446,190

(22) Filed: Jun. 5, 2006

(65) Prior Publication Data

US 2007/0007704 A1 Jan. 11, 2007

Related U.S. Application Data

(60) Provisional application No. 60/696,800, filed on Jul. 7, 2005.

(51) Int. Cl.
*B25B 5/00* (2006.01)

(52) U.S. Cl. ..... 269/246; 269/43

(58) Field of Classification Search ..... 269/246, 269/43, 277, 282, 242, 136, 95
See application file for complete search history.

(56) References Cited

U.S. PATENT DOCUMENTS

| | | | | |
|---|---|---|---|---|
| 2,620,693 | A | 12/1952 | Eslick | |
| 3,762,688 | A * | 10/1973 | Leonhardt | 254/93 R |
| 4,418,899 | A | 12/1983 | Zimmermann et al. | |
| 4,605,208 | A * | 8/1986 | Durham | 269/32 |
| 4,736,927 | A * | 4/1988 | Clancy | 254/93 R |
| 4,770,401 | A * | 9/1988 | Donaldson | 269/249 |
| 5,110,100 | A | 5/1992 | Cotton | |
| 5,139,246 | A | 8/1992 | Yakou | |
| D333,963 | S | 3/1993 | Goodman | |
| 6,340,154 | B1 * | 1/2002 | Young | 269/246 |
| D473,441 | S | 4/2003 | Cross | |
| 6,698,740 | B1 * | 3/2004 | Slagle | 269/277 |
| 7,000,911 | B2 * | 2/2006 | McCormick et al. | 269/239 |
| 7,121,539 | B2 * | 10/2006 | McCormick et al. | 269/239 |

FOREIGN PATENT DOCUMENTS

| | | | |
|---|---|---|---|
| GB | 210210 | 1/1924 | |
| JP | 55-065043 | 5/1980 | |
| JP | 10296644 | * 11/1998 | 269/246 |

* cited by examiner

*Primary Examiner*—Lee D. Wilson
(74) *Attorney, Agent, or Firm*—Richard C. Litman

(57) ABSTRACT

A power vise in which a supplementary power source is used to open and close the jaws. The power vise may be actuated by a remote control, so the operator may have both hands free to hold the workpiece as it is placed in or removed from the vise and may also include a mechanism for regulating the pressure developed between the jaws. When the power source is electric, the electrically operated vise includes an output shaft of an electric motor connected to the advance screw of the vise to turn the screw and close or open the jaws. When the power source is hydraulic, the hydraulically operated vise includes a hydraulic ram, with a first jaw affixed to the hydraulic cylinder and a second jaw affixed to the piston rod of the hydraulic device. Hydraulic pressure is used to retract and extend the piston rod, thereby closing and opening the jaws.

9 Claims, 5 Drawing Sheets

POWER VISE

CROSS-REFERENCE TO RELATED APPLICATION

This application claims the benefit of U.S. Provisional Patent Application Ser. No. 60/696,800, filed Jul. 7, 2005.

BACKGROUND OF THE INVENTION

1. Field of the Invention

The present invention relates generally to vises and clamping tools used to temporarily hold a workpiece in place. More specifically, the present invention includes a power vise using either an electric motor or a hydraulic ram to move the jaws.

2. Description of the Related Art

Vises and similar clamping tools have been known and used for generations for temporarily holding a workpiece in place to allow a worker to use both hands in performing the necessary work. Generally, such devices are manually actuated, with no power being provided for the opening and closing of the jaws. The mechanical advantage provided by the advance screw pitch in a conventional vise is sufficient to provide more than adequate clamping pressure in virtually all circumstances, so the use of power to actuate the vise is generally not due to a need for additional force.

However, oftentimes a worker must assemble or manipulate multiple part assemblies, and it can be cumbersome to hold the various parts in precisely the proper relationship to one another while simultaneously attempting to manually close the jaws on the vise to secure the parts.

A number of variations and improvements on the conventional vise configuration have been developed over the years. An example of such is found in Japanese Patent Publication No. 55-65,043 published on May 16, 1980. This device comprises (according to the drawings and English abstract) a machinist's vise having a separate bed or body to hold a frame, which in turn holds the fixed and adjustably positionable jaws of the vise. The object is to enable high pressures to be developed across the jaws without misaligning the jaws.

However, the above patent does not disclose the present invention as claimed. Thus, a power vise solving the aforementioned problems is desired.

SUMMARY OF THE INVENTION

The present invention comprises various embodiments of a power vise in which a supplementary power source (e.g., electric, hydraulic, etc.) is used to open and close the jaws. All embodiments may be actuated by a remote control of some sort, e.g., a foot pedal or the like, so the operator may have both hands free to hold the workpiece as it is placed in or removed from the vise. All embodiments may also include a mechanism for regulating the pressure developed between the jaws.

A first embodiment of the power vise is an electrically operated vise, e.g., bench vise, machine vise, etc. The output shaft of an electric motor is connected to the advance screw of the vise to turn the screw and close or open the vise jaws. A mechanical clutch may be placed between the motor and advance screw. The motor assembly may drive either end of the advance screw. The motor may be controlled by a remote foot pedal or the like.

A second embodiment of the power vise has a hydraulic ram, with a first jaw affixed to the hydraulic cylinder and a second jaw affixed to the piston rod of the hydraulic ram. Hydraulic pressure is used to retract and extend the piston rod, thereby closing and opening the jaws relative to one another. Jaw pressure or force may be regulated by controlling the hydraulic pressure, and a remote control for actuating the device may be provided.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a power vise in which a power source is connected to at least one of the vise jaws to drive the vise jaw. The vise may be screw-actuated, as in the case of a bench vise or the like, or hydraulically actuated, as desired. Electric or hydraulic power may be used to drive the driven jaw of the vise, and a force limiting mechanism may be provided between the power source and the driven jaw of the vise.

Figure 1:
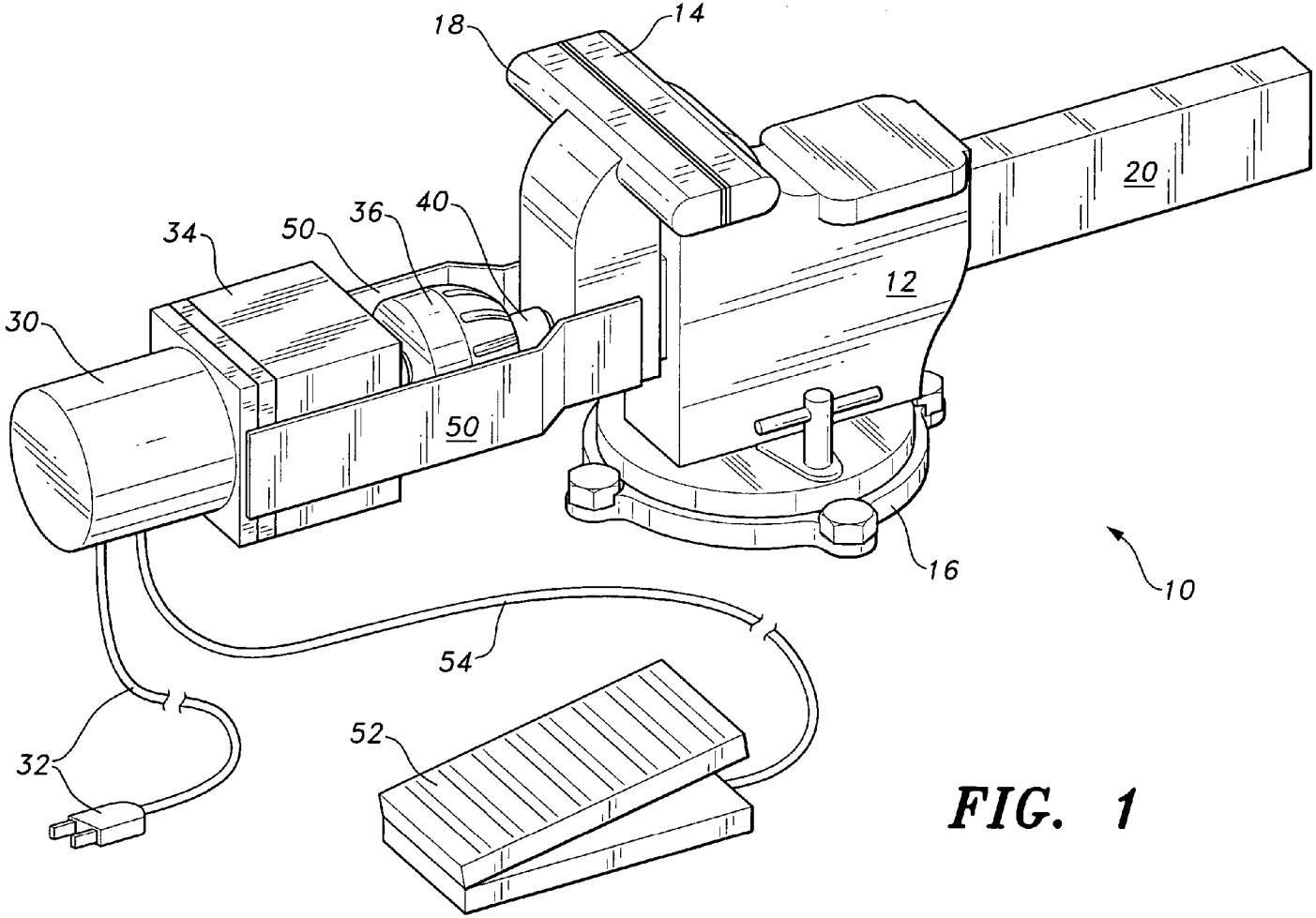
FIG. 1 is a perspective view of a first embodiment of a power vise according to the present invention.
Figure 2:
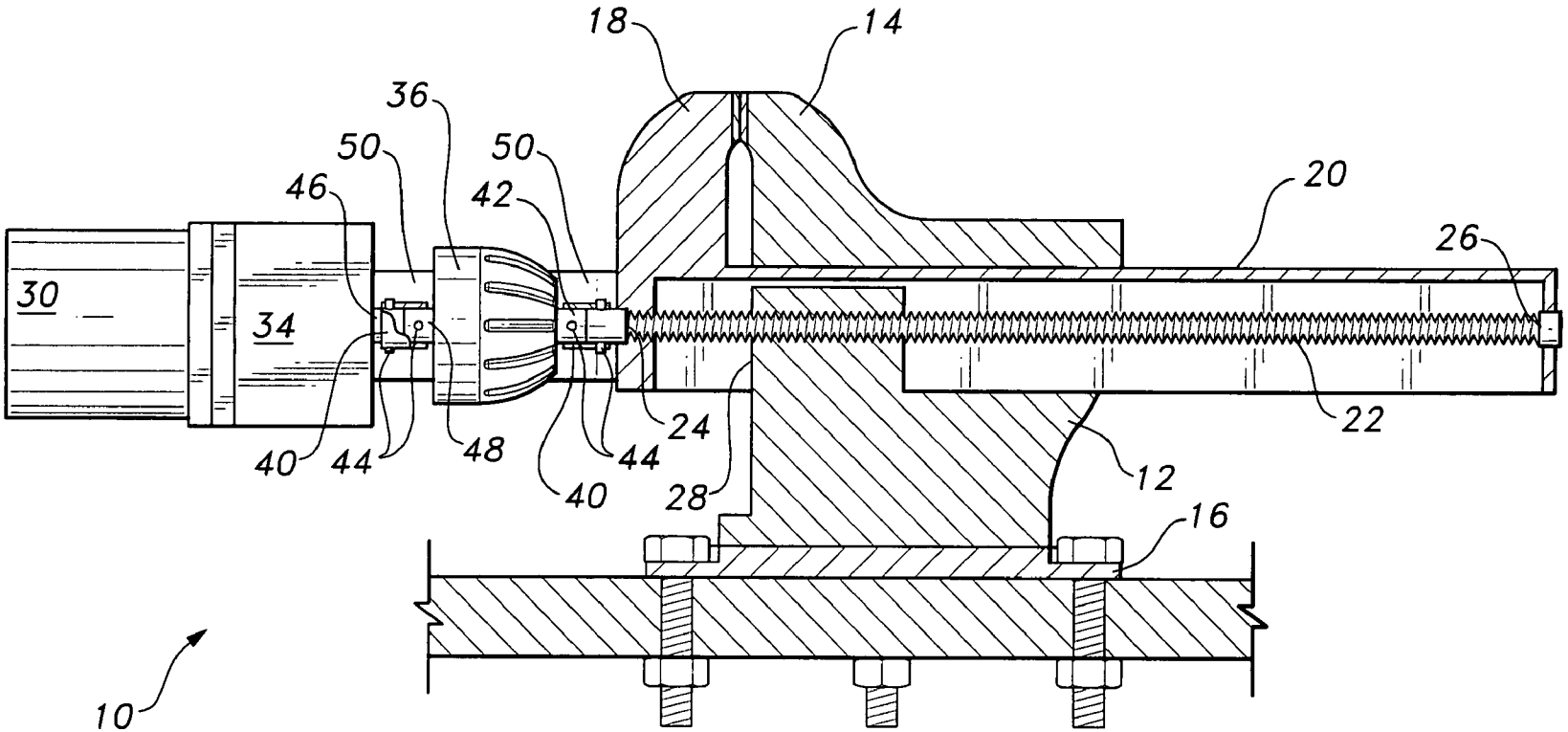
FIG. 2 is a side elevation view in partial section of the power vise of FIG. 1, showing further details thereof.
Figure 3:
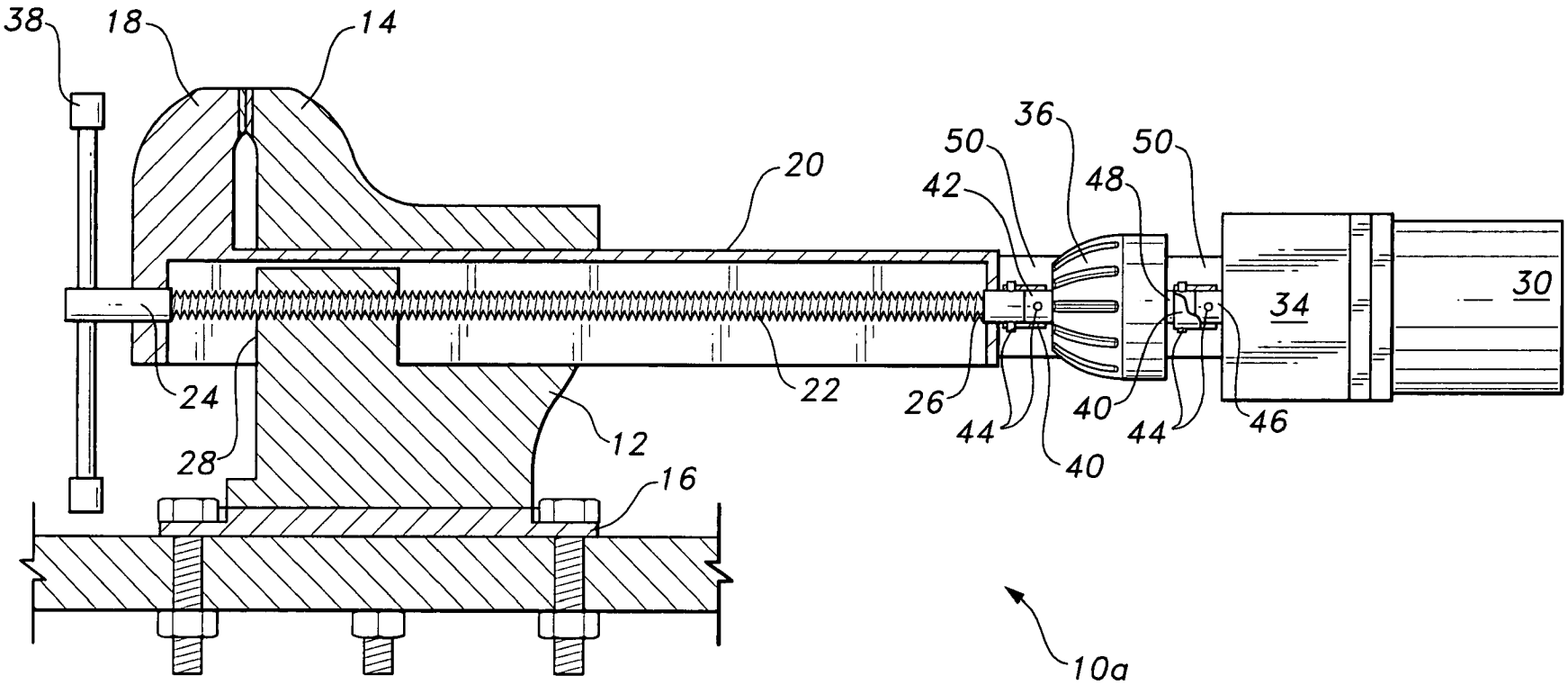
FIG. 3 is a side elevation view in partial section of an alternative configuration for the power vise of FIGS. 1 and 2 in which the motor assembly is connected to the opposite end of the advance screw.

FIGS. 1 through 3 illustrate a first type of power-driven vise in accordance with the present invention, with FIGS. 1 and 2, respectively, providing perspective and elevation views in partial section of a first embodiment of the vise. The powered vise 10 of FIGS. 1 and 2 includes a vise body 12 having a fixed jaw 14 extending therefrom, as is conventional in bench vise and machinist's vise construction. The vise body 12 may be rotationally attached to a base 16 to allow the body 12 to be repositioned for convenience. The base 16 may be immovably affixed to an underlying structure, e.g., a workbench.

A movable jaw 18 is affixed to a slide 20, which slides through the vise body 12 to open and close the jaws 14 and 18 relative to one another. The movable jaw 18 and slide 20 are actuated by a linear actuator, with the linear actuator comprising an advance or lead screw 22. The advance screw 22 includes a first end 24 affixed to the base of the moving jaw 18 but rotating therein, and an opposite second end 26 captured within the opposite distal end of the slide 20. The advance screw 22 threads through a block 28, which is a part of the base 12, to draw the slide 20 through the base 12 and advance the moving jaw 18 toward or away from the fixed jaw 14, depending upon the direction of rotation of the advance screw 22.

The above-described bench vise construction is generally conventional. However, the power vise 10 further provides a power source for rotating the advance screw 22, rather than requiring the screw 22 to be turned by hand, as in a conventional vise. In the embodiment of FIGS. 1 and 2, a power actuator comprising an electric motor 30 is attached to the first end 24 of the advance screw 22 to rotate the advance screw selectively in order to close and open the moving jaw 18. The motor 30 may be powered from the standard 115 volt ac power grid, as indicated by the electrical cord and plug 32 extending from the motor 30, or from some other electrical power supply, e.g., a battery. The motor 30 is preferably relatively small, i.e., no larger than the vise body 12, but preferably includes a gearbox 34 in order to transfer sufficient torque to the first end 24 of the advance screw 22 to which it is attached. It will also be noted that a force regulator or force limiting device 36, e.g., a mechanical clutch, is interposed between the gearbox 34 and the first end 24 of the advance screw 22 in order to preclude excessive rotational torque on the advance screw 22 and, thus, excessive clamping pressure between the two jaws 14 and 18.

FIG. 2 provides further details of the motor 30 and clutch 36 installation. In order to install the motor and clutch assembly on the first end 24 of the advance screw 22, a collar or sleeve 40 is installed over the first end 24 of the advance screw 22 and also over the coaxial output shaft 42 of the clutch 36, and is affixed to the advance screw first end 24 and clutch output shaft 42 by diametric pins 44. A similar collar or sleeve 40 and pins 44 may be used to attach the output shaft 46 of the motor 30 coaxially to the input shaft 48 of the clutch 36. Alternative attachment structures may be used for these components, e.g., non-circular shafts (square or hexagonal drive), etc.

A pair of cheek plates 50 extend from the motor 30, or more specifically from the gearbox 34, and are affixed to the movable jaw end of the slide 20. The clutch 36 may have adjustable pressure settings to regulate the amount of torque applied to the advance screw 22. Accordingly, when torque is applied to the advance screw 22 by actuation of the motor 30, gearbox 34, and clutch 36, the motor 30 and gearbox 34 cannot rotate with the advance screw 22, as the cheek plates 50 affix them to the non-rotating slide 20.

The use of a power driver, e.g., motor 30, gearbox 34, and force regulating clutch 36 for the vise advance screw 22 frees the user of the power vise 10 from the need to crank the conventional advance screw handle to close or open the vise jaws. Accordingly, the power driver may be provided with a remote control of some type, if so desired, enabling the user to have both hands free to manipulate a workpiece or workpieces within the vise jaws, if so desired. In the example of FIG. 1, a remote control device for the motor 30 is provided, comprising a foot pedal assembly 52 which may be connected to the motor 30 by a cord 54. Actuation of the pedal 52 actuates the motor 30, thereby rotating the advance screw 22 to open or close the jaws 14 and 18 relative to one another. The direction of rotation of the motor 30, and thus the advance screw 22, may be selected by conventional switch means within the pedal assembly 52, e.g., rocking the pedal in one direction for closing the jaws and rocking the pedal in the opposite direction for opening the jaws. Alternatively, the motor 30 may be actuated, and the direction of rotation of the motor's shaft may be controlled, by a push button switch(es) on the motor housing.

FIG. 3 illustrates a somewhat different embodiment of the power vise of FIGS. 1 and 2, with the power vise embodiment of FIG. 3 being designated as power vise 10*a*. All of the components 12 through 54 illustrated in the embodiment 10 of FIGS. 1 and 2 are included in the embodiment 10*a* of FIG. 3, with the difference between the two embodiments being in the relative location of the motor 30 and its gearbox 34, and the location of clutch 36. In the power vise embodiment 10*a* of FIG. 3, these components are connected to the second end 26 of the advance screw 22, i.e., the end opposite the conventional advance screw handle 38. This allows the advance screw handle 38 to remain in place on the first end 24 of the advance screw 22, enabling the vice 10*a* to optionally be used manually. This arrangement also places the bulk of the motor 30, gearbox 34, and clutch 36 at the opposite end of the vise from the two jaws 14 and 18, thereby facilitating access to the jaws.

Figure 4:
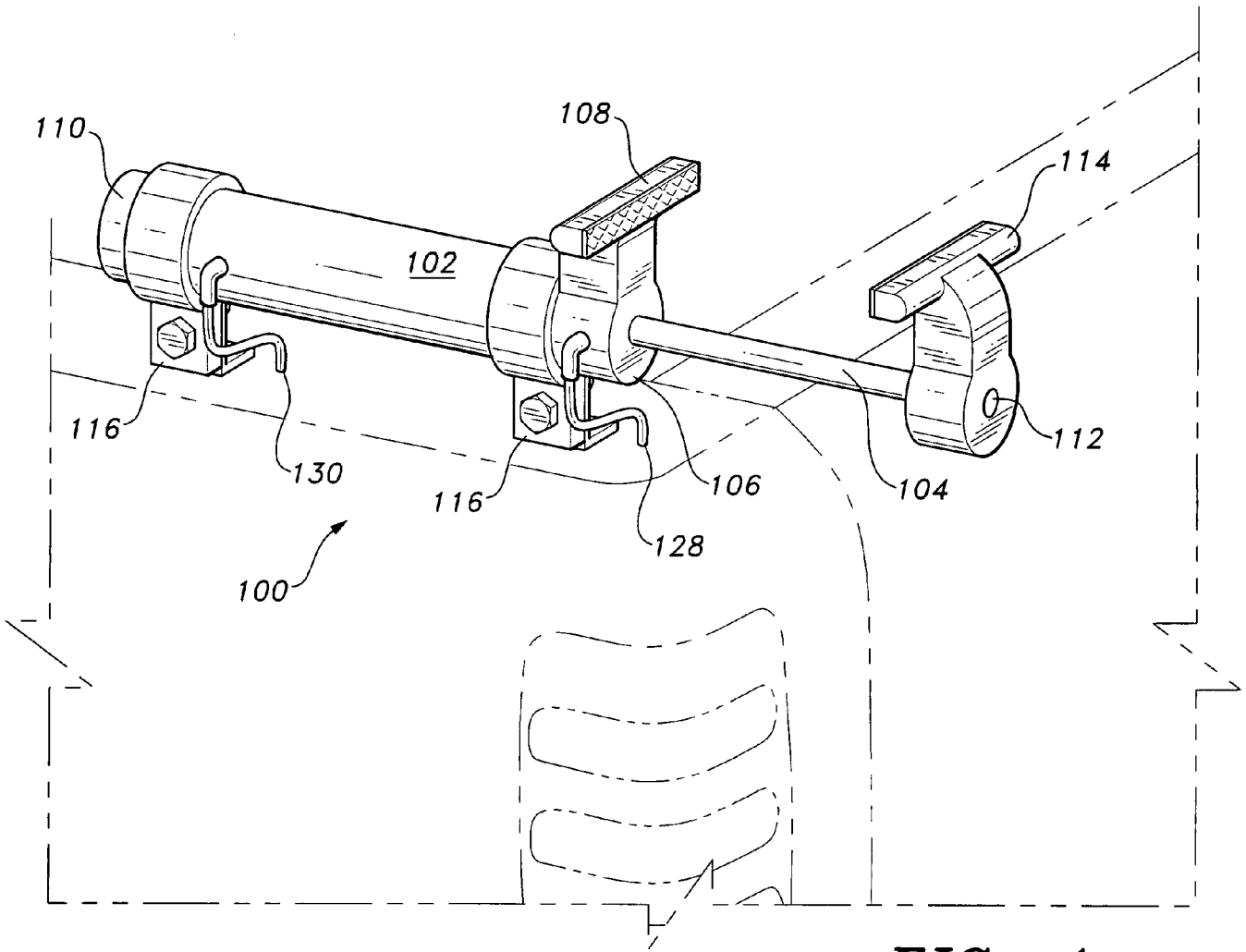
FIG. 4 is an environmental perspective view of an alternative embodiment of a power vise according to the present invention.
Figure 5:
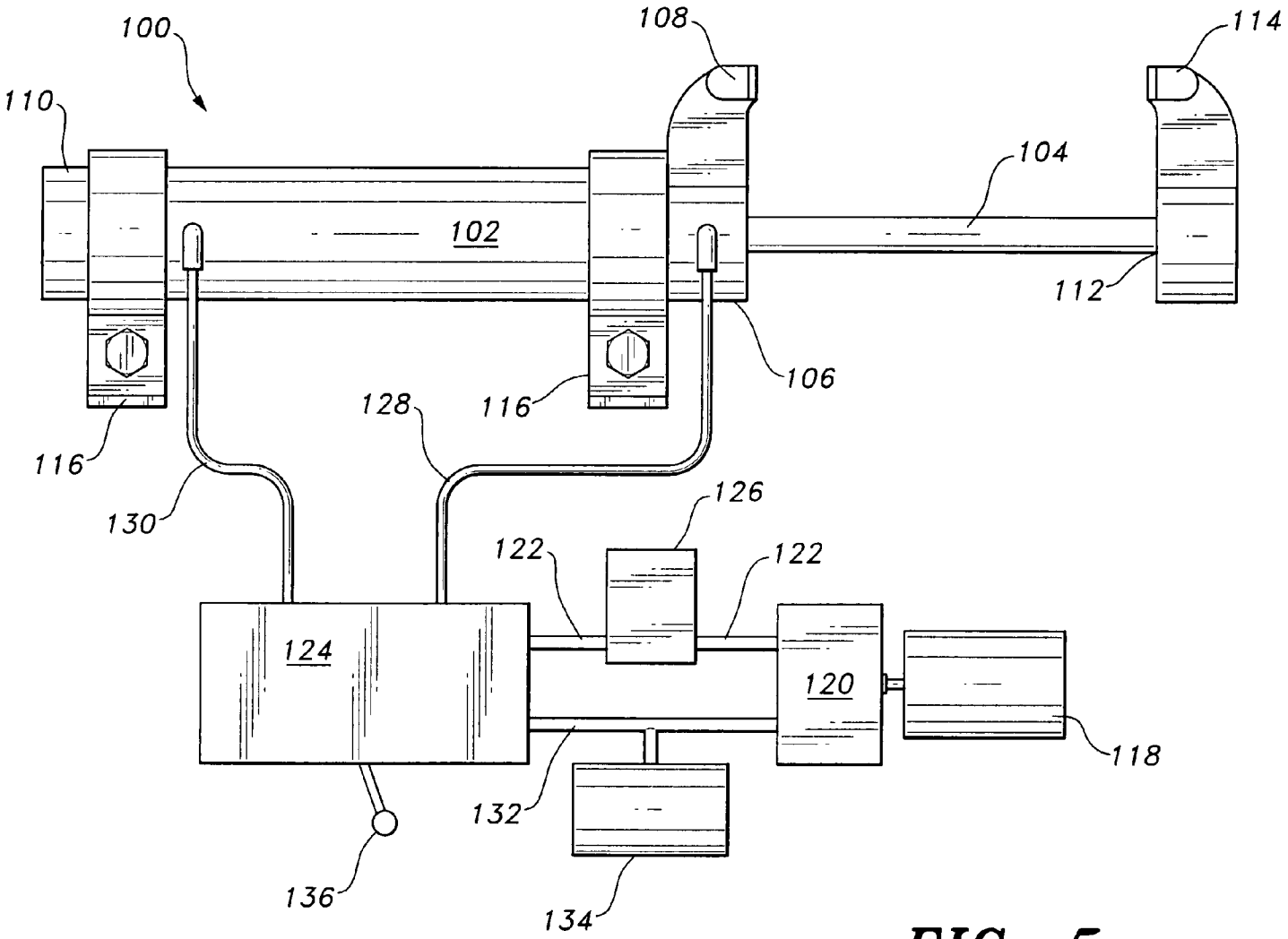
FIG. 5 is a diagrammatic view of an exemplary hydraulic system for powering the power vise of FIG. 4, including a hydraulic pressure regulator and a remote actuating control for the device.

FIGS. 4 and 5 illustrate another embodiment of the present power vise, comprising a hydraulically actuated vise 100. The relatively stationary vise body of the hydraulic power vise 100 comprises a hydraulic cylinder 102, with the linear actuator comprising a hydraulically-actuated piston rod or strut 104 disposed concentrically through the cylinder 102, selectively and hydraulically extending therefrom. The vise body cylinder 102 includes a strut or rod extension end 106 having a vise jaw 108 immovably affixed thereto, and an opposite closed end 110, with the strut or rod 104 having an internal end (not shown) conventionally disposed within the cylinder 102, and an opposite distal end 112 having a moving jaw 114 affixed thereto, i.e., the moving jaw 114 moves with extension and retraction of the linear actuator strut 104 relative to the vise body cylinder 102. Such a system can provide a considerably greater extension than the mechanical advance screw of a bench type vise such as that shown in FIGS. 1 through 3. The rod or strut 104 may be either internally or externally keyed to the cylinder 102 to prevent rotation of the rod 104 relative to the cylinder 102 and assure alignment of the two jaws 108 and 114 with one another at all times.

The above described assembly may be secured to any suitable fixed or mobile base, e.g., the bed wall of a pickup truck, as shown in broken lines in FIG. 4, to the frame of a farm tractor, etc. The two ends 106 and 110 of the vise body cylinder 102 are easily secured to a base structure by mutually opposed clamps 116, which are, in turn, secured to the base structure. The hydraulic actuation principle of the power vise 100 of FIGS. 4 and 5 lends itself well to attachment to a vehicle having a hydraulic system, e.g., a tractor having a hydraulic pump for operating supplemental equipment, or perhaps a light truck having a hydraulic system for powering a snow plow or the like.

FIG. 5 provides a diagrammatic drawing of an exemplary hydraulic system for operating the power vise 100 of FIGS. 4 and 5. A motor 118, e.g., an electric motor powered by the electrical system of the vehicle upon which the vise 100 is mounted, or perhaps a separate combustion engine prime mover, drives a hydraulic pump 120. The pump 120 supplies hydraulic fluid through a high pressure supply line 122 to a selector valve 124, via a force limiting pressure regulator 126 interposed between the pump 120 and valve 124.

The valve 124 may be selectively controlled to route hydraulic fluid under pressure to either end 106 or 110 of the vise body cylinder 102. When the valve 124 is manipulated to route hydraulic fluid under pressure to the strut extension end 106 of the cylinder, high pressure hydraulic fluid passes through the hydraulic line 128 extending between the selector valve 124 and the strut extension end 106 of the cylinder 102. This pushes the conventional internal piston of the rod 104 toward the opposite closed end 110 of the cylinder 102, thus drawing the moving jaw 114 toward the fixed jaw 108 to secure a workpiece therebetween. Hydraulic fluid captured between the internal piston of the rod 104 and the closed end 110 of the cylinder 102 is returned via the hydraulic line 130 extending between the closed end of the cylinder and the selector valve 124, thence to a return line 132 and reservoir 134 disposed between the selector valve 124 and pump 120.

When the moving jaw 114 of the hydraulically powered vise 100 is to be extended away from the fixed jaw 108, the selector valve 124 is manipulated to route high pressure fluid through the hydraulic line 130, thereby extending the strut or rod 104 from the cylinder 102. Fluid between the piston and the strut extension end 106 of the cylinder passes back to the reservoir 134 via the hydraulic line 128 from the strut extension end 106 of the cylinder to the selector valve 124, and thence back to the pump 120 via the reservoir 134 for recirculation.

It will be understood that the selector valve 124 may include either a hand-actuated lever 136, as shown in FIG. 5, or may alternatively be controlled by a foot pedal or lever of some sort, as is known in the art. A foot pedal much like that shown in FIG. 1 for the electrically powered vise 10 or 10*a* may be configured to operate the selector valve 124 of the apparatus of FIG. 5, if so desired. The foot pedal assembly may comprise the selector valve 124 of FIG. 5 and incorporate the same hydraulic valve mechanism, or may, alternatively, comprise an electrical switching device, as in the pedal assembly 52 of FIG. 1. In such case, the selector valve may incorporate electrical solenoids to drive the hydraulic valves, depending upon operation of the pedal assembly and corresponding electrical input to the solenoids of the hydraulic valve assembly.

In conclusion, the power vise in its various embodiments will be greatly appreciated by mechanics, craftsmen, and others who have occasion to use a vise or the like to temporarily secure one or more workpieces. The remotely actuated operation of the power vise, in either its electrically or hydraulically powered configurations, greatly facilitates the manipulation of a workpiece, or multiple workpieces, within the vise, leaving both of the user's hands free to handle the workpiece or workpieces. The power vise in its various embodiments is well suited for fixed installation in a shop or similar environment, but is equally well suited for mobile installation upon a suitable vehicle. Accordingly, the versatility of the operating systems employed by the power vise will prove to be a most valuable feature of the device.

It is to be understood that the present invention is not limited to the embodiments described above, but encompasses any and all embodiments within the scope of the following claims.

I claim:

1. A power vise, comprising:

a vise body;

a fixed jaw extending from the vise body;

a linear actuator disposed through the vise body, the linear actuator having a first end and a second end opposite the first end, said linear actuator including an advance screw threadably disposed through said vise body;

a moving jaw affixed to the first end of the linear actuator;

a power actuator selectively driving the linear actuator, said power actuator comprises an electric motor selectively driving said advance screw and coaxially disposed therewith; and a mechanical clutch force regulator disposed concentrically between said electric motor and said advance screw, thereby regulating the amount of torque being applied to said advance screw.

2. The power vise according to claim 1, further including a remote control selected from the group consisting of a foot pedal and a hand control.

3. The power vise according to claim 1, wherein said electric motor is connected to the first end of said advance screw.

4. The power vise according to claim 1, wherein said electric motor is connected to the second end of said advance screw.

5. The power vise according to claim 1, further including a foot pedal remote control.

6. A power vise, comprising:

a vise body;

a fixed jaw extending from the vise body;

an advance screw threadably disposed through the vise body, the advance screw having a first end and a second end opposite the first end;

a moving jaw affixed to the first end of the advance screw;

an electric motor selectively driving the advance screw and coaxially disposed therewith; and a mechanical clutch force regulator disposed concentrically between said electric motor and said advance screw, thereby regulating the amount of torque being applied to said advance screw.

7. The power vise according to claim 6, wherein said electric motor is connected to the first end of said advance screw.

8. The power vise according to claim 6, wherein said electric motor is connected to the second end of said advance screw.

9. The power vise according to claim 6, further including a foot pedal remote control.

* * * * *